United States Patent [19]

Bavetz

[11] 3,956,998

[45] May 18, 1976

[54] FURNACE WALL ASSEMBLY HAVING REDUCED THERMAL CONDUCTIVITY

[76] Inventor: James W. Bavetz, 3535 Dayton Road, Madison, Ohio 44057

[22] Filed: Aug. 6, 1975

[21] Appl. No.: 602,246

[52] U.S. Cl. ..... 110/1 A; 52/481

[51] Int. Cl.[2] ..... F23M 5/00

[58] Field of Search ..... 110/1 A; 126/19 R; 52/481, 302

[56] References Cited

UNITED STATES PATENTS

| | | | |
|---|---|---|---|
| 1,712,919 | 5/1929 | Harter | 110/1 A |
| 1,901,560 | 3/1933 | Jacobus | 110/1 A |
| 1,964,403 | 6/1934 | Loucks | 52/481 |
| 2,268,517 | 12/1941 | Small | 52/481 |

*Primary Examiner*—Edward G. Favors

[57] ABSTRACT

A furnace wall assembly is described, which is characterized by a U-shaped channel member spacing apart inner and outer furnace wall panels, said member having on its base at least three staggered, longitudinal rows of slits, the metallic edge or edges of which are displaced with respect to the plane formed by the base of the channel.

2 Claims, 2 Drawing Figures

FURNACE WALL ASSEMBLY HAVING REDUCED THERMAL CONDUCTIVITY

BACKGROUND OF THE INVENTION

Furnace wall assemblies are generally comprised of inner and outer wall panels held in spaced apart relationship by supporting members, thereby forming a dead air space or area for insertion of insulation between said panels. Conventionally, to insure adequate support and to withstand the extreme heats often involved, said members are constructed of various metals, usually ferrous metals or alloys. However, since such metals are thermally conductive, heat loss through the furnace wall is aggravated. Efforts have been made to reduce heat transfer across the supporting members by removing portions of metal from said supports, i.e., perforation. While these techniques are somewhat effective, the removal of sufficient metal to significantly lower heat loss weakens the strength of the member.

STATEMENT OF THE INVENTION

Therefore, it is an object of the present invention to provide a furnace wall assembly characterized by a high-strength support member having low heat transfer characteristics.

This and other objects of the present invention will become apparent to those skilled in the art from the specification and claims which follow.

There has now been found a furnace wall assembly comprising an inner wall panel and an outer wall panel spaced apart by at least one structurally supporting, thermally conductive member, characterized in that said member is a substantially U-shaped metal channel, the base of the U-shaped channel having therein at least three rows of longitudinally-disposed slits, the slits in each row being in staggered relation with respect to the slits in the next adjacent row and the metal on at least one side of each slit being displaced with respect to the plane formed by the channel base. Preferably, the metal on both sides of the intermediate row or rows is displaced.

A number of advantages flow from such a construction. Since slit formation does not involve the removal of metal, the supporting ability of the channel is substantially retained. Therefore more rows of slits, and consequently, a greater heat transfer reduction are possible in a given cross-section, as opposed to constructions wherein metal has been removed.

DESCRIPTION OF THE PREFERRED EMBODIMENTS

The furnace wall assembly of the present invention finds utility in a variety of ovens, furnaces, and like heating and curing apparatus, especially larger structures designed to operate at high temperatures, e.g., in excess of 500°C.

Both the inner (interior) and outer (exterior) wall panels are generally made of relatively heavy, e.g., 20 gauge, sheet metal capable of sustaining the temperatures involved without damage or significant variation in dimension. Likewise, the material of construction of the channel member is also formed of relatively heavy metal. Obviously, the dimensions of the component parts are dependent upon the intended use of the furnace and, therefore, do not comprise a part of the invention.

Figure 2:
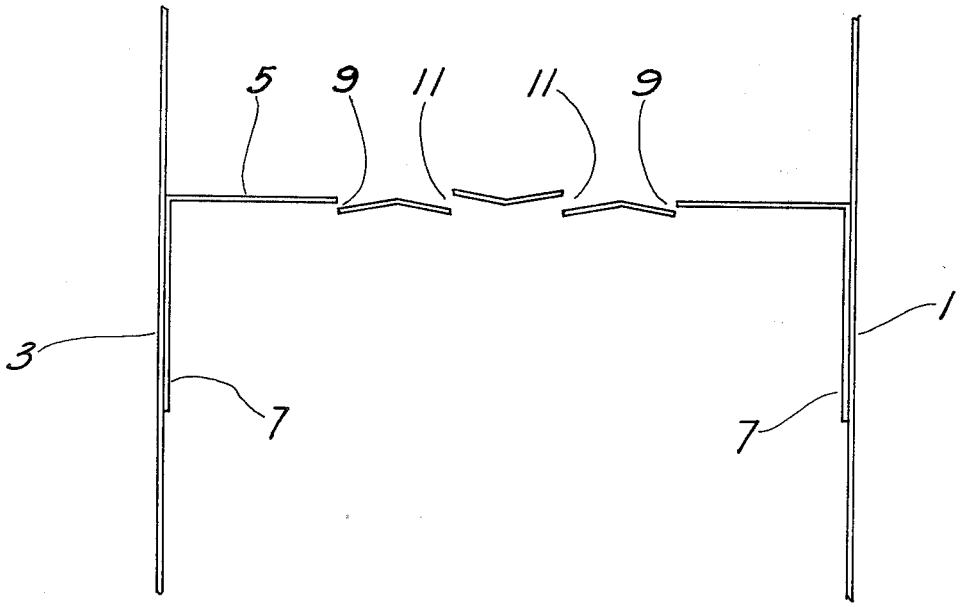
FIG. 2 is a cross-section of a furnace wall assembly employing the improved channel of the present invention.

The method of attachment of the wall panels to opposite legs of the channel, as shown in FIG. 2, is conventionally by welding, although bolts, screws, and the like may be employed.

As indicated above, the space between the panels, not occupied by the channels, may be either dead air space or filled with appropriate insulating material.

The configuration and array of the slits on the base of the U-shaped channel is critical to the present invention. First, true slits, not slots or other perforations, are employed, the distinction being that no metal is removed from the structure. This may be accomplished by known techniques, especially slit rolling wherein the metal is slit by a blade edge then one or both sides of the slit is forced, or rolled, out of the plane described by the metal member. Avoidance of removal of metal maximizes the structural strength of the channel.

Secondly, at least three rows of longitudinally disposed slits must be present, the upper number being dictated by the width of the channel base. Further, the slits in each longitudinal row must be staggered with respect to the next adjacent row of slits in order to maximize the heat transfer path.

Finally, the metal on at least one, and preferably both, sides of each slit must be displaced with respect to the plane described by the channel base. Where both sides are displaced, displacement should be in opposite directions. The reason for such displacement is to allow circulation of air through the slits and/or to maximize the distance between edges of the slits, thus lessening heat take-up across the slit.

Figure 1:
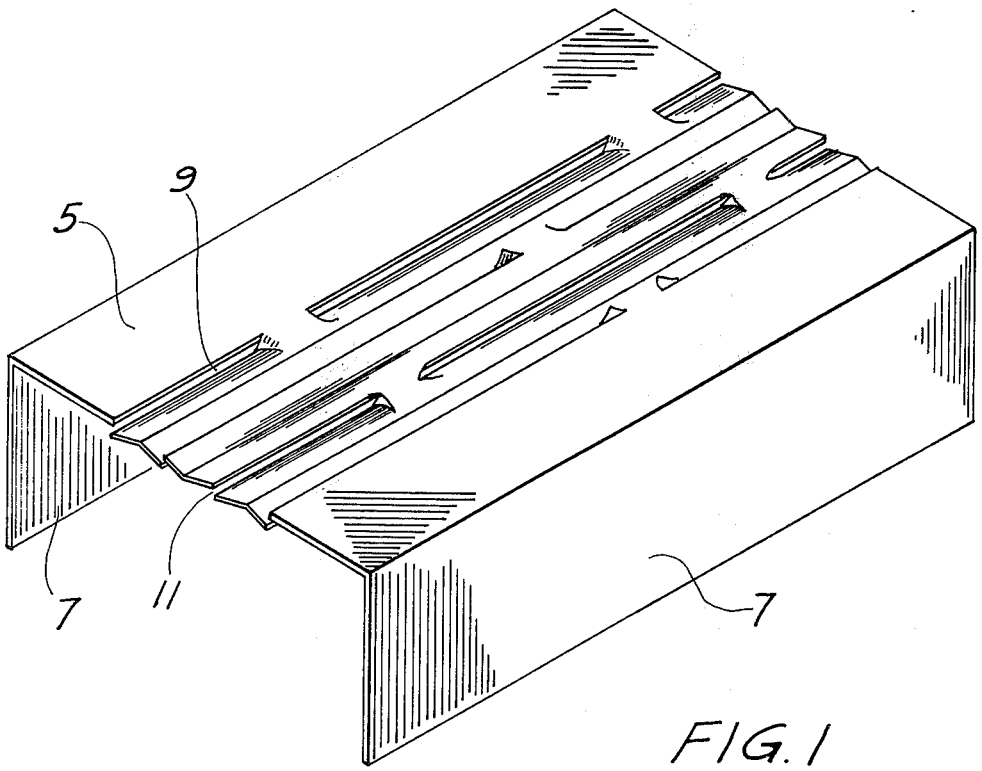
FIG. 1 is a perspective view of a U-shaped channel member according to the present invention.

FIGS. 1 and 2 depict a typical and preferred embodiment of the present invention. Wall panels 1 and 3 are spaced apart by U-shaped channel 5, the legs 7 of which are attached to said panels, for example, by welding. A series of rows of slits 9 and 11, four of which are shown, are spaced along the length of the base of said channel 5, the slits in each row being staggered with respect to those in the next adjacent row. The metal on the outer rows of slits 9 is displaced on one side with respect to the plane of the base while the metal on both sides of the intermediate rows of slits 11 is displaced with respect to the same plane but in opposite directions.

To demonstrate the importance of the configuration shown and claimed, like channels of 20 gauge steel are formed, the bases of which are 10.16 cm across. In one channel base are formed 4 staggered rows of 15.24 cm long slits with the metal edges being displaced as shown in the drawings. In the other channel base, 2 staggered rows of slots are punched out, each slot having a length of 15.24 cm and being 1.27 cm wide. Pressure is applied to the channel legs in the direction of the center of the base of each channel. While the slitted channel will support up to 454 kg, the slotted channel buckles at 181 kg. Further, the heat transfer across the base of each channel is measured and found to be only 57°C. in the present invention, as opposed to 71°C. with the slotted design.

I claim:

1. In a furnace wall assembly comprising an inner wall panel and an outer wall panel spaced apart by at least one structurally supporting, thermally conductive member, the improvement wherein said member is a substantially U-shaped metal channel, the base of the U-shaped channel having therein at least three rows of longitudinally disposed slits, the slits in each row being in staggered relation with respect to the slits in the next adjacent row and the metal on at least one side of each slit being displaced with respect to the plane formed by the channel base.

2. An assembly as in claim 1 wherein the metal on one side of the slits on the outer rows of slits is displaced with respect to the plane of the base and the metal on both sides of all intermediate rows is displaced in opposite directions with respect to said plane.

* * * * *